US007387580B2

(12) United States Patent
Hasegawa

(10) Patent No.: US 7,387,580 B2
(45) Date of Patent: Jun. 17, 2008

(54) GOLF PUTTER HEAD AND GOLF PUTTER INCLUDING THE SAME

(75) Inventor: Hiroshi Hasegawa, Kobe (JP)

(73) Assignee: SRI Sports Ltd., Kobe (JP)

( * ) Notice: Subject to any disclaimer, the term of this patent is extended or adjusted under 35 U.S.C. 154(b) by 268 days.

(21) Appl. No.: 11/253,762

(22) Filed: Oct. 20, 2005

(65) Prior Publication Data

US 2006/0100030 A1 May 11, 2006

(30) Foreign Application Priority Data

Nov. 9, 2004 (JP) ..... 2004-324903

(51) Int. Cl.
*A63B 53/04* (2006.01)

(52) U.S. Cl. ..... 473/340; 473/255; 473/313; 473/341

(58) Field of Classification Search ..... 473/324–350, 473/219–256, 313
See application file for complete search history.

(56) References Cited

U.S. PATENT DOCUMENTS 2,222,534 A * 11/1940 Harris ..... 473/248
4,754,976 A * 7/1988 Pelz ..... 473/340
5,080,365 A * 1/1992 Winchell ..... 473/255
5,700,207 A * 12/1997 Guthrie et al. ..... 473/313
5,716,290 A * 2/1998 Baker et al. ..... 473/313
6,171,203 B1 * 1/2001 Huang ..... 473/305
6,663,497 B2 * 12/2003 Cameron ..... 473/245
6,991,555 B2 * 1/2006 Reese ..... 473/251
2002/0123393 A1 9/2002 Tang et al.

FOREIGN PATENT DOCUMENTS

JP 2003-339926 A 12/2003

* cited by examiner

*Primary Examiner*—Sebastiano Passaniti
(74) *Attorney, Agent, or Firm*—Birch, Stewart, Kolasch & Birch, LLP

(57) ABSTRACT

A golf putter head 1 includes a head body having a face surface, and a head rear portion affixed to a back side of the head body and having a greater specific gravity than that of the head body. Provided that S1 represents a cross-sectional area of the head body with respect to a cross-section taken at a boundary portion K between the head body and the head rear portion and along a plane parallel to the face surface, whereas S2 represents a cross-sectional area of the head rear portion with respect to a cross-section taken at the boundary portion K and along a plane parallel to the face surface, a value of (S2/S1) is 1.1 or more and 2.0 or less.

5 Claims, 8 Drawing Sheets

GOLF PUTTER HEAD AND GOLF PUTTER INCLUDING THE SAME

BACKGROUND OF THE INVENTION

The present invention relates to a golf putter head using different materials in combination and a golf putter including this putter head.

Performances required of the golf putter head include: stroke stability, a good hit feel upon impact with a ball, reduced head vibration in a case where a ball impact point is deviated from face center, extended ball roll distance, and the like. Putter head design has been contrived in various ways in order to achieve the stroke stability and the reduced head vibration. For instance, a design is made such as to increase the moment of inertia of the head by increasing the total head weight or by affixing a weight of a high specific gravity to a peripheral portion of the head. The putter heads have typical configurations such as so-called toe-heel balance type and mallet type. Particularly, there have been recently proposed putter heads for achieving the above performances, which putter heads include one that has a special configuration different from such typical configurations, and one that is provided with a relatively soft insert in a face.

Japanese Unexamined Patent Publication No.2003-339926, for example, discloses a golf putter head, the gravity center of which is shifted rearwardly from a face portion by means of a rear mass portion having a central opening extended therethrough in a toe-heel direction, and which is provided with a face insert in a face surface, the face insert being formed from polyurethane or the like.

SUMMARY OF THE INVENTION

In a case where it is desired to increase the moment of inertia of the head with respect to the right-left direction thereof, the head may be expanded in the back direction or in the toe-heel direction as practiced in the prior art. In this case, however, a problem exists that the expanded head is increased in weight so that the putter becomes less easy to swing. In a case where the head weight is not increased, on the other hand, a problem exists that an impact upon hitting on a place off the sweet spot is transmitted to the hands so that an impaired hit feel is experienced.

The inertial moment with respect to the right-left direction of the head means a moment of inertia of the head about a vertical axis through the gravity center of the head in a standard state where the head is placed on the horizontal plane at a predetermined lie angle and loft angle (real loft angle) (hereinafter, simply referred to as "standard state"). Hereinafter, this moment of inertia will be simply referred to as the inertial moment. In a case where the predetermined lie angle or loft angle of the head is not particularly specified, the predetermined lie angle and loft angle may be a normal lie angle (70° to 72°) and a normal loft angle (0° to 6°) of the putter head.

The present inventor has found that an ability to effectively absorb the head vibration is implemented based on an absolutely different technical concept from the prior-art technical concept which teaches to simply increase the head weight or to simply increase the inertial moment, and accomplished the invention.

An object of the present invention is to provide a golf putter head which is capable of maintaining ease of swing and also of effectively absorbing the head vibration at impact with a ball thereby reducing the impact transmitted to the hands, as well as to provide a golf putter using the same.

The golf putter head according to the present invention includes a head body having a face surface, and a head rear portion affixed to a back side of the head body and having a greater specific gravity than that of the head body, wherein provided that S1 represents a cross-sectional area of the head body with respect to a cross-section taken at a boundary portion between the head body and the head rear portion and along a plane parallel to the face surface, whereas S2 represents a cross-sectional area of the head rear portion with respect to a cross-section taken at the boundary portion and along a plane parallel to the face surface, a value of (S2/S1) is 1.1 or more and 2.0 or less.

In this case, the head rear portion protrudes relative to the head body in a toe-heel direction and/or a top-sole direction at the boundary portion between the head rear portion and the head body. The head may be effectively increased in impact absorbing performance because the head rear portion is provided with a protuberant portion having a different specific gravity from that of the head body, using a different material from that of the head body and having a different vibration characteristic from that of the head body. The reason for limiting the value of (S2/S1) to the above range is because it is less likely to obtain a sufficient vibration absorption effect if the value of (S2/S1) is less than 1.1, and because if the value of (S2/S1) exceeds 2.0, the weight of the head rear portion or the total head weight tends to increase so much that the ease of swing may be decreased or instable stroke may be experienced due to an impaired head balance. In addition, the existence of the head rear portion having a relatively high specific gravity makes it possible to increase the inertial moment.

In the above golf putter head, an arrangement may be made such that provided that L1 represents a toe-heel length of the head body as determined at the boundary portion, whereas L2 represents a toe-heel length of the head rear portion as determined at the boundary portion, a value of (L2/L1) is 1.1 or more and 2.0 or less. In this case, the head rear portion is protruded in the toe-heel direction at the above boundary portion so that the vibration absorption effect may be increased. In addition, there can be effectively absorb the head vibration caused particularly when the ball impact point is deviated in the toe-heel direction. The reason for defining the value of (L2/L1) to be 1.1 or more is because it is less likely to obtain the sufficient vibration absorption effect if the value of (L2/L1) is less than 1.1. Thus, the value of (L2/L1) may more preferably be 1.2 or more and even more preferably 1.3 or more. The reason for defining the value of (L2/L1) to be 2.0 or less is because if the value of (L2/L1) exceeds 2.0, the weight of the head rear portion or the total head weight tends to increase so much that the ease of swing may be reduced or the instable stroke may be experienced due to the impaired head balance. Thus, the value of (L2/L1) may more preferably be 1.9 or less, even more preferably 1.8 or less and particularly preferably 1.7 or less.

In the above golf putter head, an arrangement may be made such that provided that H1 represents a top-sole length of the head body as determined at the boundary portion, whereas H2 represents a top-sole length of the head rear portion as determined at the boundary portion, a value of (H2/H1) is 1.1 or more and 2.0 or less.

In this case, the head rear portion is protruded in the top-sole direction at the boundary portion so that the vibration absorption effect may be increased. In addition, there can be effectively absorb the head vibration caused particularly when the ball impact point is deviated in the top-sole direction. The reason for defining the value of (H2/H1) to be 1.1 or more is because it is less likely to obtain the sufficient vibration absorption effect if the value of (H2/H1) is less than 1.1. Thus, the value of (H2/H1) may more preferably be 1.2 or more and even more preferably 1.3 or more. The reason for defining the value of (H2/H1) to be 2.0 or less is because if the value of (H2/H1) exceeds 2.0, the weight of the head rear portion or the total head weight tends to increase so much that the ease of swing may be reduced or the instable stroke may be experienced due to the impaired head balance. Thus, the value of (H2/H1) may more preferably be 1.9 or less, even more preferably 1.8 or less and particularly preferably 1.7 or less.

In the present invention, the toe-heel direction is defined as a direction parallel to the face surface of the head and to the horizontal plane in the aforementioned standard state. The top-sole direction is defined as a direction perpendicular to the horizontal plane in the standard state, i.e. the vertical direction. The face-back direction is defined as a direction perpendicular to the toe-heel direction and to the top-sole direction.

According to the present invention as described above, the head may be increased in the vibration absorption effect while maintaining the ease of swing and the head balance because the head rear portion is protruded in the toe-heel direction or the top-sole direction at the boundary portion between the head rear portion and the head body and because the area of the protuberant portion is limited to an optimum range.

DETAILED DESCRIPTION OF THE PREFERRED EMBODIMENTS

Preferred embodiments of the present invention will hereinbelow be described with reference to the accompanying drawings.

Figure 1A:
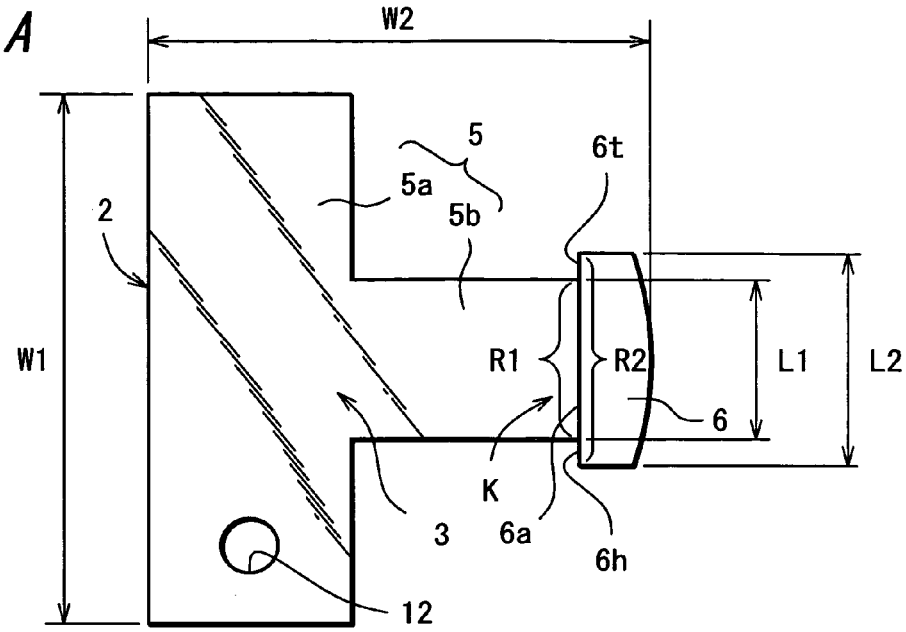
FIG. 1A is a plan view of a head according to one embodiment of the invention and Example 1 as viewed from above.
Figure 1B:
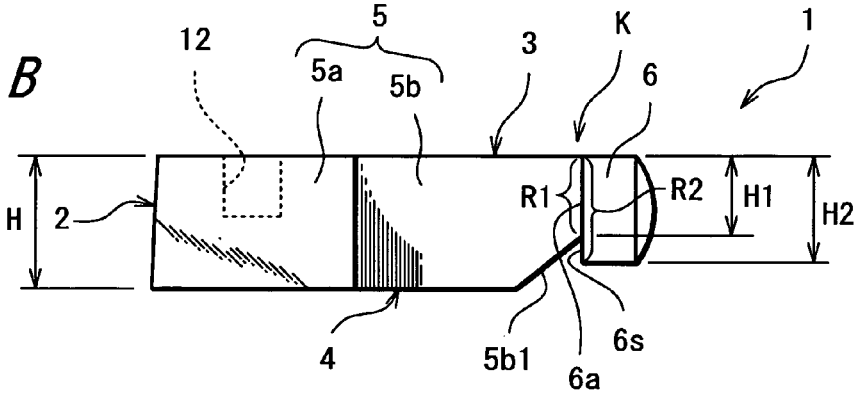
FIG. 1B is a side view of the head according to one embodiment of the invention and Example 1 as viewed from the heel side.
Figure 1C:
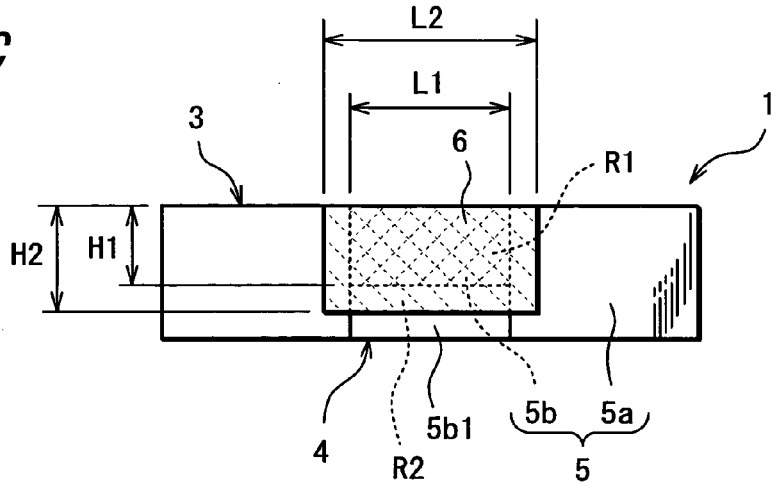
FIG. 1C is a view of the head according to one embodiment of the invention and Example 1 as viewed from the back side.
Figure 7:
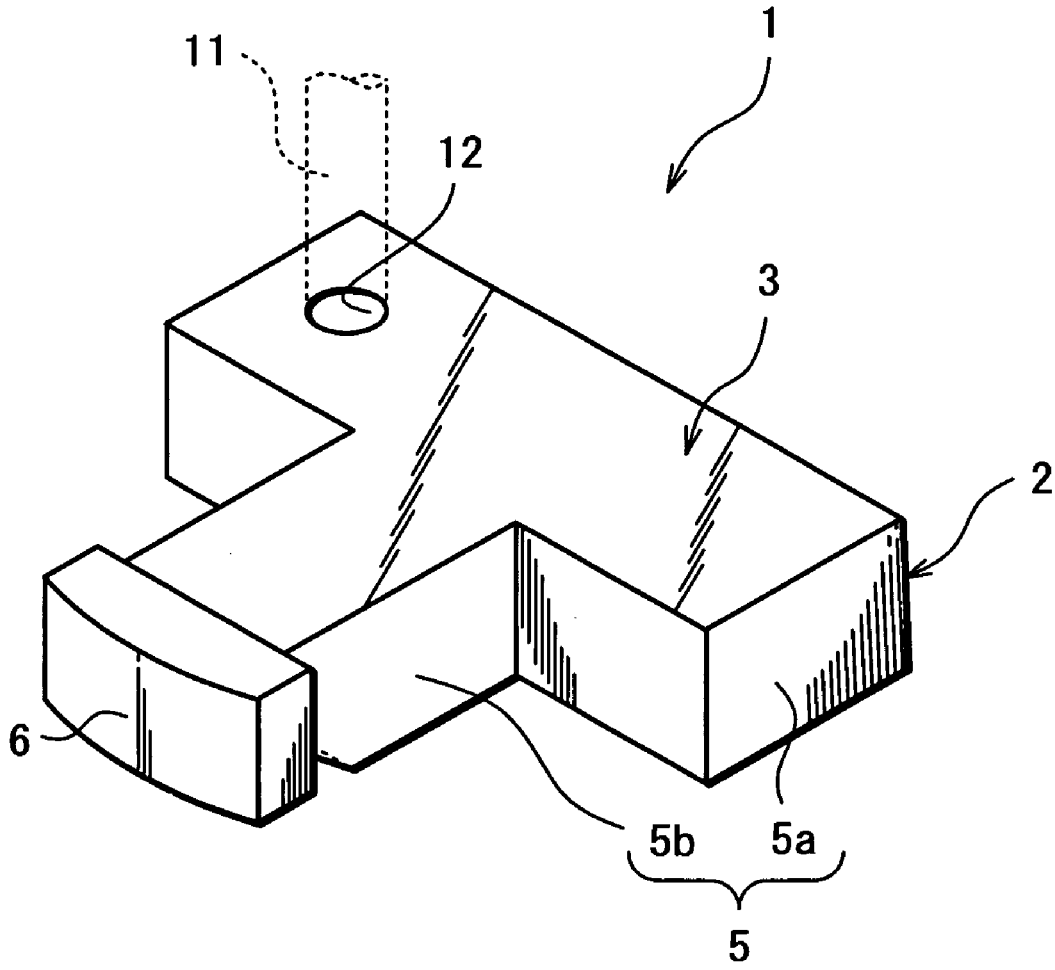
FIG. 7 is a perspective view of the head shown in FIG. 1A to FIG. 1C.

FIG. 1A to FIG. 1C and FIG. 7 illustrate a golf putter head 1 according to one embodiment of the present invention (hereinafter, simply referred to as "head") FIG. 1A is a plan view of the head as viewed from above. FIG. 1B is a side view of the head as viewed from the heel side, whereas FIG. 1C is a view of the head as viewed from the back side. FIG. 7 is a perspective view of the head.

The head 1 includes: a face surface 2 contacting a ball at impact with the ball; a crown surface 3 constituting a top surface of the head as extending from an upper edge of the face surface 2 to a back side of the head; and a sole surface 4 constituting a bottom surface of the head as extending from a lower edge of the face surface 2 to the back side of the head.

The head 1 includes two members having different specific gravities to each other. Specifically, the head includes: a head body 5 having the face surface 2; and a head rear portion 6 affixed to a back side of the head body 5 and having the greater specific gravity than that of the head body 5. The head body 5 is formed with a shaft hole 12 at a place on a heel side thereof, to which a shaft 11 (FIG. 7) is insertedly bonded. The head body 5 and the head rear portion 6 may be bonded together by any of the known methods such as press-fit, caulking, adhesive bonding and welding.

As shown in FIG. 1A, the head body 5 substantially defines a T-shape as seen in top plan and includes: a body front portion 5*a* substantially shaped like a rectangular parallelepiped including the face surface 2 and extending along the face surface 2; and a body rear portion 5*b* substantially shaped like a rectangular parallelepiped extending in a face-back direction from a toe-heel center of a back-side face of the body front portion 5*a*. The body front portion 5*a* and the body rear portion 5*b* are formed in one piece and are both solid members. The head rear portion 6 is affixed to a back side of the body rear portion 5*b*.

In the head body 5, top surfaces of the body front portion 5*a*, the body rear portion 5*b* and the head rear portion 6 are all defined by flat planes. The top surface of the body front portion 5*a* is coplanar with that of the body rear portion 5*b*. Furthermore, the top surface of the head rear portion 6 is also coplanar with those of the body front portion 5*a* and the body rear portion 5*b*. These surfaces in coplanar relation constitute the crown surface of the head 1.

On the other hand, the overall bottom surface of the body front portion 5*a* is defined by a flat plane, whereas a part of a bottom surface of the body rear portion 5*b* is defined by a flat plane which is coplanar with the overall bottom surface of the body front portion 5*a*. The bottom surface of the body front portion 5*a* and the bottom surface portion of the body rear portion 5*b* in coplanar relation constitute the sole surface 4. It is noted here that the overall bottom surface of the body rear portion 5*b* does not constitute a flat plane. Specifically, the bottom surface of the body rear portion 5*b* includes a slant surface 5*b*1 extended from a place intermediate the face-back length thereof as inclined upwardly (refer to FIG. 1B). The slant surface 5*b*1 extends to a back-side end of the body rear portion 5*b*.

In this manner, the head body 5 is provided with the body rear portion 5*b* having a smaller cross-sectional area than that of the body front portion 5*a* with respect to cross-sections parallel to the face surface 2, whereby a face-back distance between the face surface 2 and the head rear portion 6 is increased without excessively increasing the head weight. Thus, the head body is increased in the inertial moment and the depth of gravity center by virtue of the increased face-back distance in combination with the head rear portion 6 affixed to the back-side end of the body rear portion 5*b*.

At a boundary portion K between the head rear portion 6 and the head body 5, the head rear portion 6 protrudes relative to the head body 5 in the toe-heel direction as well as in the top-sole direction. Specifically, the head rear portion 6 includes a protuberant portion protruding relative to the head body 5 at the boundary portion K in the toe-heel direction and/or the top-sole direction. More specifically, the head rear portion includes: a toe-protuberant portion 6*t* and a heel-protuberant portion 6*h* protruding relative to the head body 5 in the toe-heel directions (refer to FIG. 1A); and a downward protuberant portion 6*s* protruding relative to the head body 5 in a vertically downward direction (refer to FIG. 1B).

It is provided that S1 represents a cross-sectional area of the head body with respect to a cross-section taken at the boundary portion K between the head body 5 and the head rear portion 6 and along a plane parallel to the face surface 2 (an area of a region R1 indicated by diagonally-right-up hatched broken lines in FIG. 1C), and that S2 represents a cross-sectional area of the head rear portion 6 with respect to a cross-section taken at the boundary portion K and along a plane parallel to the face surface 2 (an area of a region R2 indicated by diagonally-right-down hatched broken lines in FIG. 1C) The area S1 of the region R1 is equal to a cross-sectional area of the body rear portion 5*b* with respect to a cross-section taken at the back-side end thereof and along a plane parallel to the face surface 2. On the other hand, the area S2 of the region R2 is equal to a cross-sectional area of the head rear portion 6 (a portion exclusive of a back-side curved portion) with respect to a cross-section taken along a plane parallel to the face surface 2.

The value of (S2/S1) is defined to be 1.1 or more and 2.0 or less.

The aforementioned FIG. 1C, and FIG. 2C, FIG. 3C and FIG. 4C to be described herein later are views of the head as viewed from the back side. These figures show the aforementioned regions R1 and R2 in a see-through fashion.

Of a face-side surface 6*a* of the head rear portion 6, the area of an exposed portion which is not in contact with the head body 5 (hereinafter, referred to as "protuberant area") may preferably be 0.5 $cm^2$ or more and more preferably 0.9 $cm^2$ or more. If the protuberant area is too small, the head rear portion 6 tends to provide a decreased vibration absorption effect. In addition, the protuberant area may preferably be 15 $cm^2$ or less, more preferably 10 $cm^2$ or less and particularly preferably 4 $cm^2$ or less. If the protuberant area is too great, the head rear portion 6 becomes so large that head balance may be impaired and instable stroke may be experienced. According to the present embodiment, the face-side surface 6*a* is substantially parallel to the face surface 2. Therefore, the protuberant area is substantially equal to a value given by subtracting the area S1 from the area S2.

A boundary between the head body 5 and the head rear portion 6 exists on an extension plane which is defined by extending respective face-side surfaces of the protuberant portions 6*t*, 6*h*, 6*s* till the respective extended surfaces become continuous with one another. This extension plane coincides with the face-side surface 6*a* of the head rear portion 6. That is, the face-side surface 6*a* defines a boundary surface between the head body 5 and the head rear portion 6 (hereinafter, simply referred to as "boundary surface"). In the head 1, the face-side surface 6*a* of the head rear portion 6 (or the boundary surface) and the face surface 2 are in substantially parallel relation but not in perfectly parallel relation. That is, the head 1 has a real loft angle on the order of 4°, so that the face surface 2 is not in parallel to an axis of the shaft hole. On the other hand, the face-side surface 6*a* of the head rear portion 6 is in parallel to the axis of the shaft hole. Hence, the boundary surface between the head body 5 and the head rear portion 6 is slightly inclined relative to the face surface 2. There is another case where the boundary portion between the head body 5 and the head rear portion 6 includes a concavo-convex fit-engagement portion or the like. In this case, as well, the boundary surface between the head body 5 and the head rear portion 6 is not in parallel to the face surface 2. In the above cases, a cross-section parallel to the face surface 2 does not coincide with the boundary surface. However, the cross-sectional areas S1, S2 of the cross-sections taken at the boundary portion K and along planes parallel to the face surface 2 may be defined as follows.

First, the cross-sectional area S1 may be defined as that of a cross section of the head body 5 taken along a plane parallel to the face surface 2, in which the plane does not include the cross section of the head rear portion 6 and is located at the closest position (with respect to the face-back direction) to the boundary surface between the head body 5 and the head rear portion 6 (hereinafter, also referred to as "boundary-adjacent cross section of the head body 5"). The cross-sectional area S2 may be defined as that of a cross section of the head rear portion 6 taken along a plane parallel to the face surface 2, in which the plane does not include the cross section of the head body 5 and which is located at the closest position (with respect to the face-back direction) to the boundary surface between the head body 5 and the head rear portion 6 (hereinafter, also referred to as "boundary-adjacent cross section of the head rear portion 6"). Thus, the aforementioned lengths L1 and H1 may be defined as the lengths of the boundary-adjacent cross section of the head body 5 defined in the foregoing, whereas the lengths L2 and H2 may be defined as the lengths of the boundary-adjacent cross section of the head rear portion 6 defined in the foregoing.

Provided that L1 represents a toe-heel length of the head body 5 as determined at the boundary portion K, whereas L2 represents a toe-heel length of the head rear portion 6 as determined at the boundary portion K, as shown in FIG. 1C, the value of (L2/L1) is defined to be 1.1 or more and 2.0 or less. Provided that H1 represents a top-sole length of the head body 5 as determined at the boundary portion K, whereas H2 represents a top-sole length of the head rear portion 6 as determined at the boundary portion K, the value of (H2/H1) is defined to be 1.1 or more and 2.0 or less.

The head 1 of the above configuration offers the following function and effects.

The head may effectively be increased in impact absorbing performance because there are provided the protuberant portions 6*t*, 6*h*, 6*s* which have a different specific gravity from that of the head body 5, use a different material from that of the head body 5 and have a different vibration characteristic from that of the head body 5. Furthermore, the provision of the toe-protuberant portion 6*t* and the heel-protuberant portion 6*h* allows the head to effectively absorb head vibration produced particularly when a ball impact point is deviated in the toe-heel direction. In addition, the provision of the downward protuberant portion 6*s* allows the head to effectively absorb the head vibration produced particularly when the ball impact point is deviated in the vertical direction.

The value of (S2/S1) is defined to be 1.1 or more for the following reason. If the value of (S2/S1) is less than 1.1, it is less likely to obtain the sufficient vibration absorption effect. Thus, the value of (S2/S1) may more preferably be 1.2 or more and particularly preferably 1.3 or more. The value of (S2/S1) is defined to be 2.0 or less for the following reason. If the value of (S2/S1) exceeds 2.0, the weight of the head rear portion or the total head weight tends to increase so much that the ease of swing may be reduced or that the instable stroke may be experienced due to the impaired head balance. Thus, the value of (S2/S1) may more preferably be 1.9 or less, even more preferably 1.8 or less and particularly preferably 1.7 or less.

The cross-sectional area S2 may preferably be 2 $cm^2$ or more, more preferably 4 $cm^2$ or more and particularly preferably 5 $cm^2$ or more. If the cross-sectional area S2 is too small, the head tends to suffer an insufficient vibration absorbing performance. Furthermore, it becomes difficult to form the aforementioned protuberant portions. In addition, the cross-sectional area S2 may preferably be 15 $cm^2$ or less, more preferably 12 $cm^2$ or less and particularly preferably 9 $cm^2$ or less. If the cross-sectional area S2 is too great, the instable stroke may be experienced due to the impaired head balance. The cross-sectional area S1 may be so defined as to give the value of (S2/S1) in the aforementioned range. The lower limit of the cross-sectional area S1 may preferably be at least 1 $cm^2$, more preferably at least 2 $cm^2$ and particularly preferably at least 3 $cm^2$. The upper limit of the cross-sectional area S1 may preferably be up to 10 $cm^2$, more preferably up to 7 $cm^2$ and particularly preferably up to 6 $cm^2$.

The value of (L2/L1) is defined to be 1.1 or more for the following reason. If the value of (L2/L1) is less than 1.1, it is less likely to obtain the sufficient vibration absorption effect. Thus, the value of (L2/L1) may preferably be 1.2 or more and particularly preferably 1.3 or more. The value of (L2/L1) is defined to be 2.0 or less for the following reason. If the value exceeds 2.0, the weight of the head rear portion or the total head weight tends to increase so much that the ease of swing may be reduced or that the instable stroke may be experienced due to the impaired head balance. Thus, the value of (L2/L1) may more preferably be 1.9 or less, even more preferably 1.8 or less and particularly preferably 1.7 or less.

The length L2 may preferably be 15 mm or more, more preferably 20 mm or more and particularly preferably 25 mm or more. If the length L2 is too short, the head tends to be lowered in the vibration absorbing performance. Furthermore, it becomes difficult to form the protuberant portions protruded in the toe-heel directions. In addition, the length L2 may preferably be 120 mm or less, more preferably 100 mm or less and particularly preferably 60 mm or less. If the length L2 is too long, the head balance may be impaired and the instable stroke may be experienced. The length L1 may be so defined as to give the value of (L2/L1) in the aforementioned range. The lower limit of the length L1 may preferably be at least 10 mm, more preferably at least 15 mm and even more preferably at least 20 mm. The upper limit of the length L1 may preferably be up to 110 mm, more preferably up to 90 mm and even more preferably up to 50 mm.

The value of (H2/H1) is defined to be 1.1 or more for the following reason. If the value of (H2/H1) is less than 1.1, it is less likely to obtain the sufficient vibration absorption effect. Thus, the value of (H2/H1) may preferably be 1.2 or more and particularly preferably 1.3 or more. The value of (H2/H1) is defined to be 2.0 or less for the following reason. If the value of (H2/H1) exceeds 2.0, the weight of the head rear portion 6 or the total head weight tends to increase so much that the ease of swing may be reduced or that the instable stroke may be experienced due to the impaired head balance. Thus, the value of (H2/H1) may more preferably be 1.9 or less, even more preferably 1.8 or less and particularly preferably 1.7 or less.

The length H2 may preferably be 5 mm or more, more preferably 7 mm or more and particularly preferably 10 mm or more. If the length H2 is too short, the head tends to be lowered in the vibration absorbing performance. Furthermore, it becomes difficult to form the protuberant portion protruded in the top-sole direction. In addition, the length H2 may preferably be 40 mm or less, more preferably 35 mm or less and particularly preferably 30 mm or less. If the length H2 is too long, the instable stroke may be experienced due to the impaired head balance. The length H1 may be so defined as to give the value of (H2/H1) in the aforementioned range, or preferably be in the range of 10 to 30 mm.

The specific gravity of the head body 5 may preferably be 5 or less, more preferably 4.5 or less and particularly preferably 4.0 or less. If the specific gravity of the head body 5 is too great, a weight to be allocated to the head rear portion 6 is decreased so that the head 1 tends to be reduced in the inertial moment. In addition, the specific gravity of the head body 5 may preferably be 1.0 or more, more preferably 1.2 or more and particularly preferably 1.5 or more. If the specific gravity of the head body 5 is too small, the head body 5 is prone to be short in strength. Besides, such a material of low specific gravity is limited in availability. Examples of a material suitable for use in the head body 5 include aluminum, aluminum alloys, magnesium alloys, resins and the like. Alternatively, the head body 5 may use plural types of materials having different specific gravities. In this case, a mean specific gravity of the overall head body 5 is regarded as the specific gravity of the head body 5.

The specific gravity of the head rear portion 6 may preferably be 7 or more, more preferably 8 or more and particularly preferably 9 or more. If the specific gravity of the head rear portion 6 is too small, the inertial moment tends to decrease. In addition, the head rear portion 6 may preferably have a specific gravity of 20 or less. This is because a material having a specific gravity in excess of 20 is limited in availability. Examples of a material suitable for use in the head rear portion 6 include tungsten-nickel (W—Ni) stainless steel, tungsten and the like.

Apart from the head rear portion 6, a weight having a greater specific gravity than that of the head body 5 may be affixed to the head 1 on a toe-side or a heel-side thereof. In this case, the head may be further increased in the inertial moment.

The total weight of the head 1 may preferably be 250 g or more and more preferably 300 g or more. If the total head weight is too small, the head is prone to vibrate during stroke so that the instable stroke may be experienced. Furthermore, the head vibration tends to increase at impact with the ball. In addition, the total head weight may preferably 420 g or less and more preferably 360 g or less. If the total head weight is too great, the putter tends to be less easy to swing.

The weight of the head rear portion 6 may preferably be 4% or more of the total head weight and more preferably 7% or more. If the weight percentage of the head rear portion 6 is too small, the head rear portion 6 tends to provide a decreased vibration absorption effect. Furthermore, the inertial moment is decreased so that the instable stroke is more likely to be experienced. In addition, the weight of the head rear portion 6 may preferably be 23% or less of the total head weight and more preferably 20% or less. If the weight percentage of the head rear portion 6 is too great, the head is impaired in balance so that the ease of swing tends to decrease.

The inertial moment of the head 1 (the aforesaid inertial moment with respect to right-left direction) may preferably be 4000 $g \cdot cm^2$ or more and more preferably 5000 $g \cdot cm^2$ or more. If the inertial moment is too small, the head is prone to vibrate during stroke so that the instable stroke is more likely to be experienced. Furthermore, the head vibration tends to increase at impact with the ball. In addition, the head 1 may preferably have the inertial moment of 9000 $g \cdot cm^2$ or less and more preferably 8500 $g \cdot cm^2$ or less. If the inertial moment is too great, the ease of swing tends to decrease.

The maximum toe-heel length W1 of the head 1 (refer to FIG. 1A) may preferably be 50 mm or more, more preferably 60 mm or more and particularly preferably 70 mm or more. If the length W1 is too small, the direction of the face surface 2 may be less recognizable at address so that it may become difficult to hit the ball in an intended direction. Furthermore, the head also tends to be decreased in the inertial moment, making it difficult to accomplish a stable stroke. In addition, the length W1 may preferably be 200 mm or less, more preferably 150 mm or less and particularly preferably 130 mm or less. If the length W1 is too great, the total head weight is increased so much that the putter becomes less easy to swing. Furthermore, disadvantages in terms of putter carriage and storage result.

The maximum face-back length W2 of the head 1 (FIG. 1A) may preferably be 20 mm or more, more preferably 30 mm or more, even more preferably 40 mm or more and particularly preferably 60 mm or more. If the length W2 is too small, the head tends to be decreased in the inertial moment, making it difficult to accomplish the stable stroke. At address, it becomes difficult to orient the face surface to an intended ball rolling direction. Furthermore, the head may be set in position less stably during address. In addition, the length W2 may preferably be 200 mm or less, more preferably 150 mm or less and particularly preferably 130 mm or less. If the length W2 is too great, the head is increased in weight so much that the ease of swing may be reduced or that the back side of the head 1 is more likely to be rubbed against the ground when the ball is hit.

The total head height H (refer to FIG. 1B) or the maximum top-sole length of the head 1 may preferably be 10 mm or more, more preferably 25 mm or more and particularly preferably 30 mm or more. If the height H is too small, the face surface 2 has such a small top-sole width that the head tends to be less easy to hit with. In addition, the total head height H may preferably be 50 mm or less, more preferably 45 mm or less and particularly preferably 40 mm or less. If the height H is too great, the face surface 2 has such a great top-sole width that the variation of the impact point tends to increase in the top-sole direction.

In the present invention, a face insert formed from a softer material than the material for the head body 5 may be provided. The vibration absorbing performance may be further increased by using such a face insert. As a suitable material for the face insert, a resin such as urethane or an elastomer may be used.

EXAMPLES AND COMPARATIVE EXAMPLES

The effects of the present invention were examined by fabricating putter clubs of examples and comparative examples and evaluating the putter clubs.

First, head configurations of the individual examples will be described with reference to the drawings.

The head 1 of the above embodiment was used as that of Example 1. In Example 1, the body rear portion 5*b* had a toe-heel length of 30 mm and a top-sole length of 25 mm. The head rear portion 6 had a face-back width of 8 mm (a width at a toe-side end and a heel-side end of the head rear portion 6), a top-sole length of 20 mm and a toe-heel length of 40 mm.

Figure 2A:
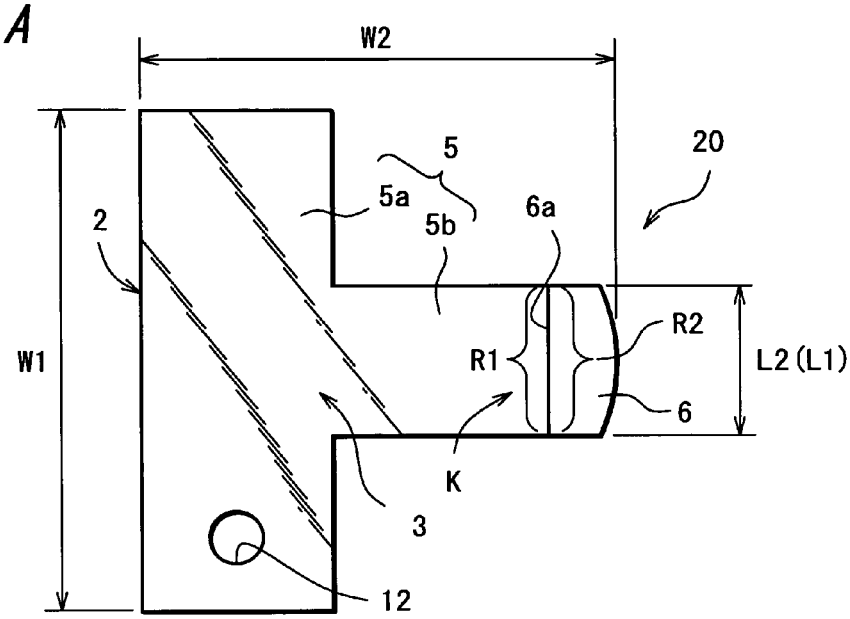
FIG. 2A is a plan view of a head according to Example 2 as viewed from above.
Figure 2B:
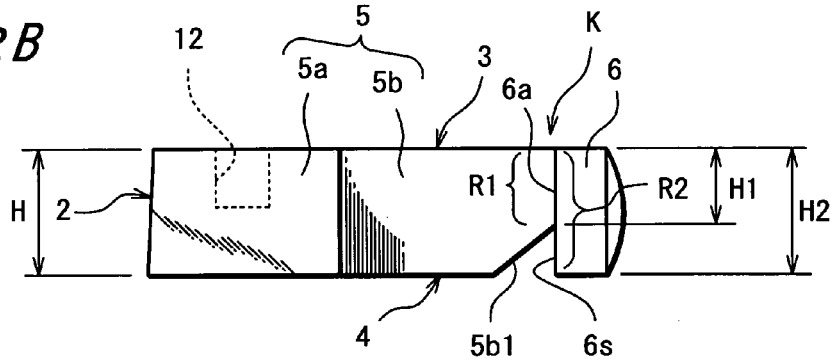
FIG. 2B is a side view of the head according to Example 2 as viewed from the heel side.
Figure 2C:
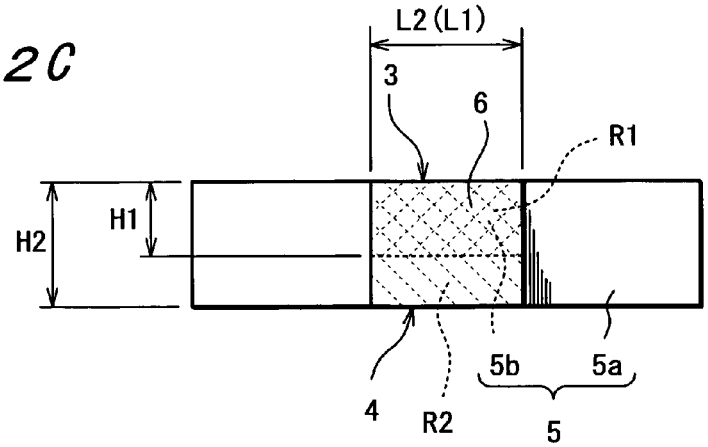
FIG. 2C is a view of the head according to Example 2 as viewed from the back side.

A configuration of a head 20 used in Example 2 is shown in FIG. 2A to FIG. 2C. Example 2 was specified in the same way as Example 1, except that the head rear portion 6 had a toe-heel length of 30 mm and a top-sole length of 25 mm. In Example 2, the length L2 was equal to the length L1 which was 30 mm, whereas the length H2 was greater than that of Example 1 and was equal to the total head height H which was 25 mm.

Example 3 and Example 4 were specified in the same way as Example 1 and Example 2, except that the toe-heel length and top-sole length of the head rear portion 6 were varied. In Example 3, the length H1 and the length H2 were both 15 mm.

Figure 3A:
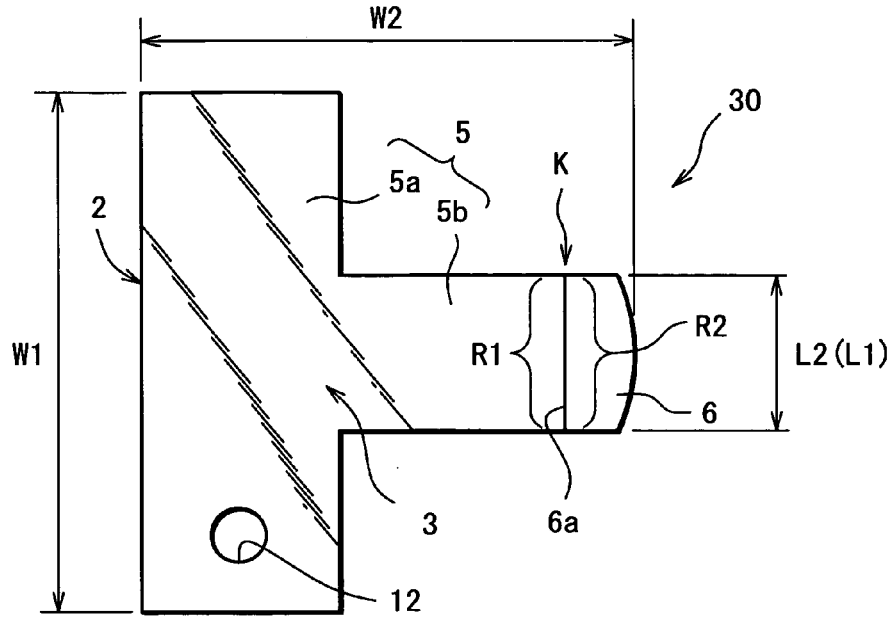
FIG. 3A is a plan view of a head according to Comparative Example 1 as viewed from above.
Figure 3B:
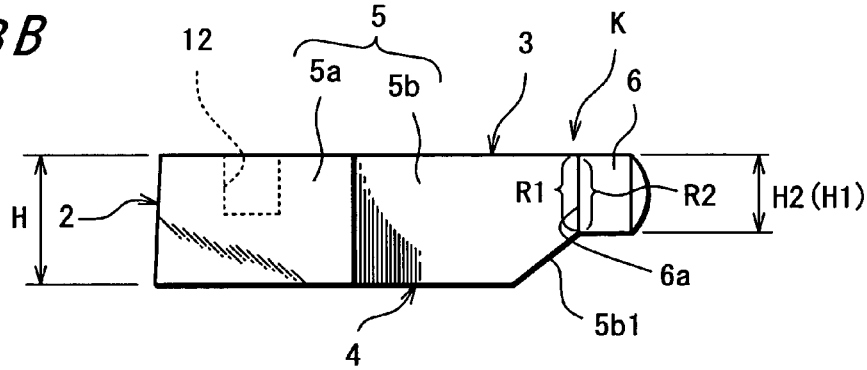
FIG. 3B is a side view of the head according to Comparative Example 1 as viewed from the heel side.
Figure 3C:
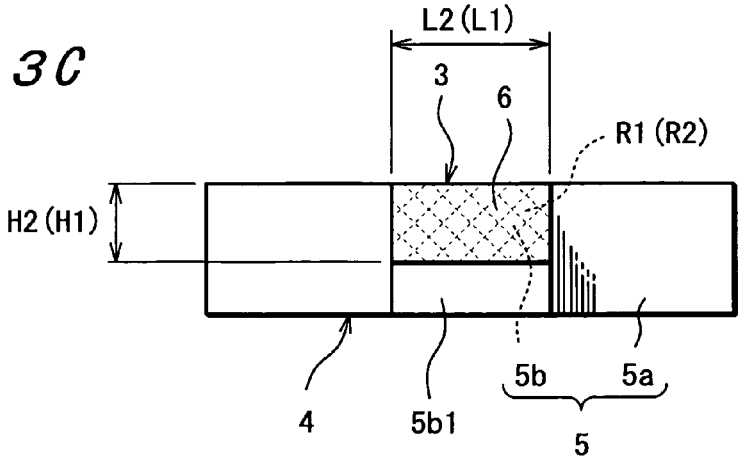
FIG. 3C is a view of the head according to Comparative Example 1 as viewed from the back side.

A head 30 used in Comparative Example 1 is shown in FIG. 3A to FIG. 3C. The head of Comparative Example 1 was specified in the same way as that of Example 1, except that the head rear portion 6 had a toe-heel length of 30 mm and a top-sole length of 15 mm. As shown in FIG. 3C, Comparative Example 1 is defined such that S1=S2, L1=L2 and H2=H1.

Figure 4A:
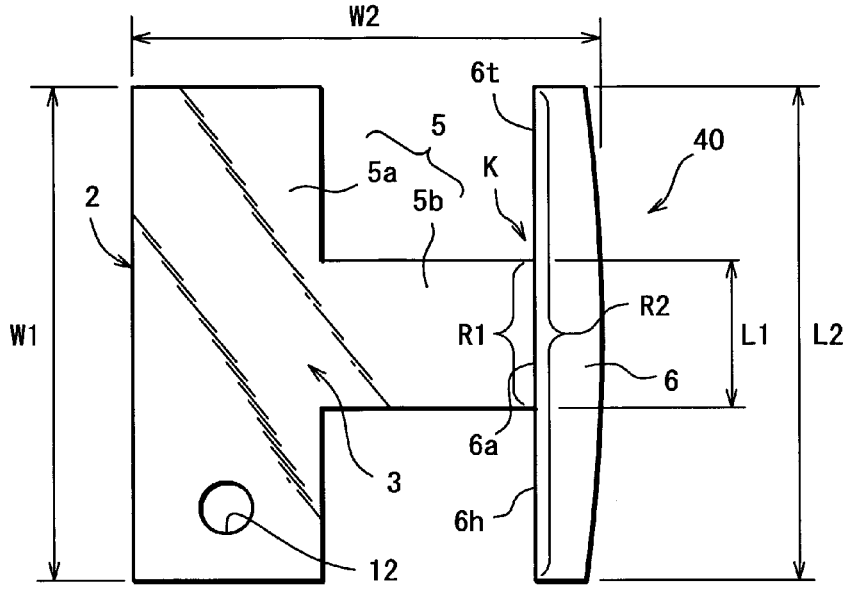
FIG. 4A is a plan view of a head according to Comparative Example 2 as viewed from above.
Figure 4B:
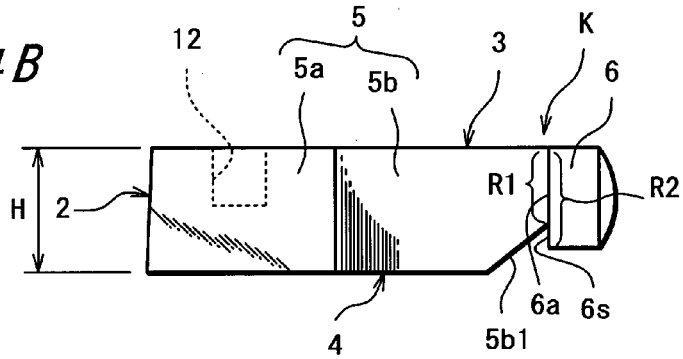
FIG. 4B is a side view of the head according to Comparative Example 2 as viewed from the heel side.
Figure 4C:
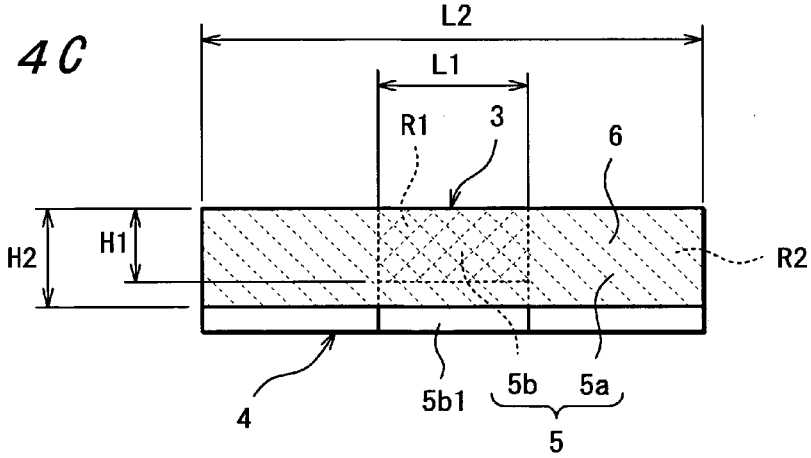
FIG. 4C is a view of the head according to Comparative Example 2 as viewed from the back side.

A head 40 used in Comparative Example 2 is shown in FIG. 4A to FIG. 4C. The head of Comparative Example 2 was specified in the same way as that of Example 1, except that the head rear portion 6 had a toe-heel length of 100 mm which was equal to a toe-heel length of the face.

Figure 5A:
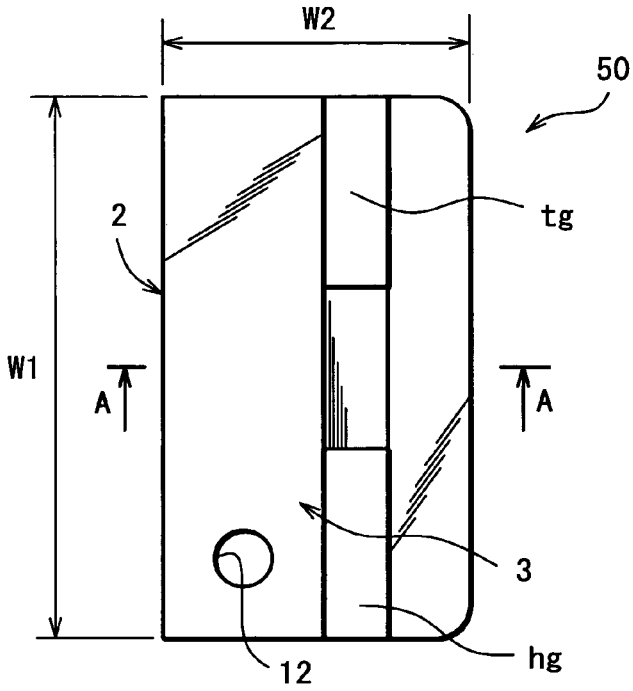
FIG. 5A is a plan view of a head according to Comparative Example 3 as viewed from above.
Figure 5B:
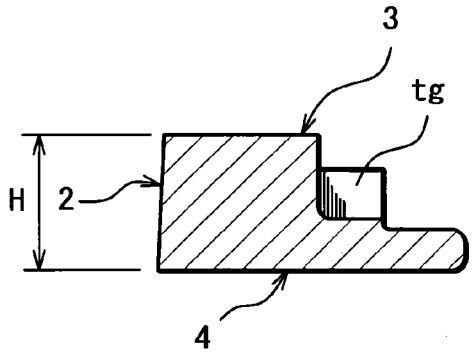
FIG. 5B is a sectional view taken along the line A-A in FIG. 5A.
Figure 5C:
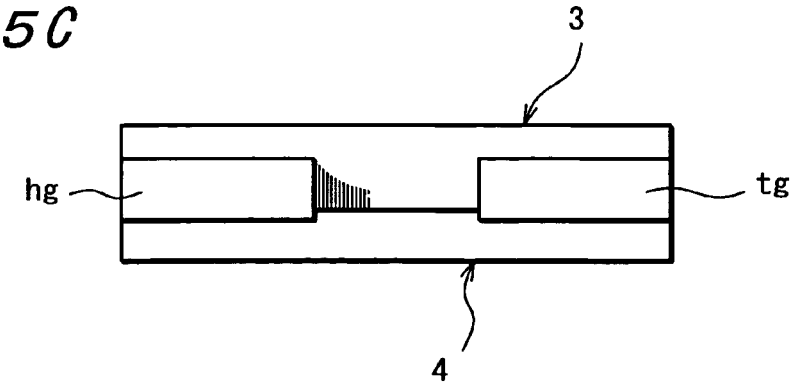
FIG. 5C is a view of the head according to Comparative Example 3 as viewed from the back side.

A head 50 used in Comparative Example 3 is shown in FIG. 5A to FIG. 5C. FIG. 5A is a plan view of the head 50 as viewed from above. FIG. 5B is a sectional view taken along the line A-A in FIG. 5A, whereas FIG. 5C is a view of the head 50 as viewed from the back side. This head 50 is also shown in a perspective view of FIG. 8. The head 50 is a putter head of a so-called toe-heel balance type and includes a toe-side weight concentration portion tg and a heel-side weight concentration portion hg. It is noted, however, that the head 50 does not include a neck. Similarly to the head 1 and the like, the head 50 includes the shaft hole 12.

Figure 6A:
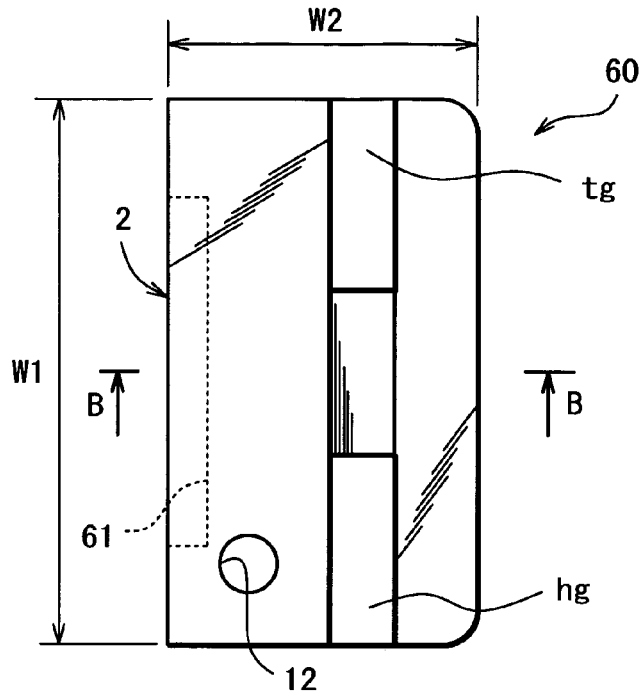
FIG. 6A is a plan view of a head according to Comparative Example 4 as viewed from above.
Figure 6B:
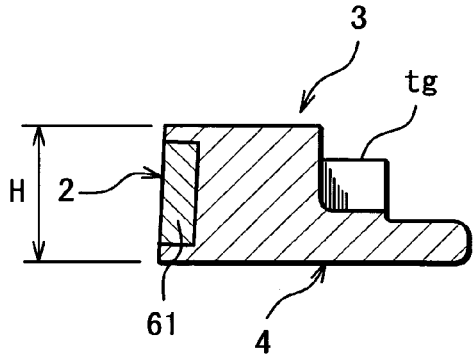
FIG. 6B is a sectional view taken along the line B-B in FIG. 6A.
Figure 6C:
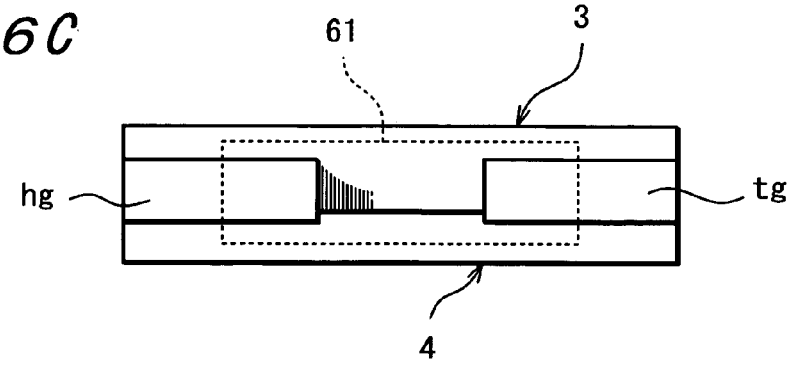
FIG. 6C is a view of the head according to Comparative Example 4 as viewed from the back side.
Figure 8:
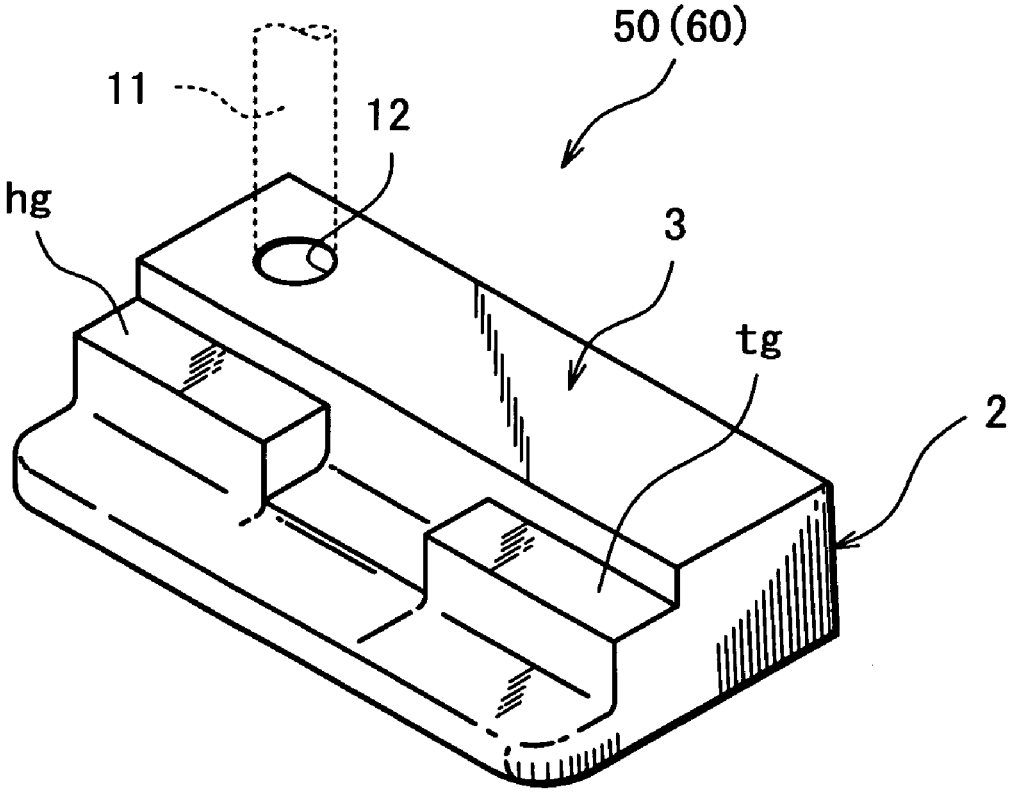
FIG. 8 is a perspective view of the head shown in FIG. 5A to FIG. 5C and FIG. 6A to FIG. 6C.

A head 60 used in Comparative Example 4 is shown in FIG. 6A to FIG. 6C. A perspective view of the head 60 is shown in FIG. 8 like in the case of the head 50. The head 60 was specified in the same way as the head 50 of Comparative Example 3, except that the face surface 2 of the head body is formed with a cavity, in which a face insert 61 formed from a urethane resin is fitted.

In specifications common to the all of the examples and the comparative examples, the maximum toe-heel length W1 was 100 mm and the total head height H was 25 mm. The area and configuration of the face surface 2 were also common to the all of the examples. That is, the face surface 2 had a toe-heel length of 100 mm and a top-sole length of 25 mm. All the examples had common shaft and grip mounted thereto.

The specifications and evaluations of the individual examples are listed in Table 1 as below.

TABLE 1

| | Ex. 1 | Ex. 2 | Ex. 3 | Ex. 4 | CEx. 1 | CEx. 2 | CEx. 3 | CEx. 4 |
|---|---|---|---|---|---|---|---|---|
| Head body material | | | Aluminum alloy | | | | Stainless steel | |
| Head body forming method | | | Machining | | | | Casting | |
| Head rear portion material | | | Stainless steel | | | | — | — |
| Face insert | — | — | — | — | — | — | — | used |
| Face insert material | — | — | — | — | — | — | — | Urethane |
| Specific gravity of head body | 2.7 | 2.7 | 2.7 | 2.7 | 2.7 | 2.7 | 7.8 | 7.8 |
| Specific gravity of head rear portion | 7.8 | 7.8 | 7.8 | 7.8 | 7.8 | 7.8 | — | — |
| Sectional area S1 ($cm^2$) | 4.5 | 4.5 | 4.5 | 4.5 | 4.5 | 4.5 | — | — |
| Sectional area S2 ($cm^2$) | 8 | 7.5 | 6.0 | 8.6 | 4.5 | 20 | — | — |
| Length L1 (mm) | 30 | 30 | 30 | 30 | 30 | 30 | — | — |
| Length L2 (mm) | 40 | 30 | 40 | 43 | 30 | 100 | — | — |
| Length H1 (mm) | 15 | 15 | 15 | 15 | 15 | 15 | — | — |
| Length H2 (mm) | 20 | 25 | 15 | 20 | 15 | 20 | — | — |
| Length W2 (mm) | 95 | 95 | 95 | 95 | 95 | 95 | 35 | 35 |
| Total head weight (g) | 350 | 350 | 350 | 350 | 330 | 420 | 350 | 345 |
| Head volume ($cm^3$) | 100 | 98 | 98 | 102 | 90 | 105 | 70 | 70 |
| Inertial moment ($g \cdot cm^2$) | 6500 | 6200 | 6400 | 6650 | 6100 | 6800 | 4100 | 4000 |
| Impact to hands | ◎ | ◎ | ◎ | ◎ | ○ | ◎ | Δ | ○ |
| Ease of stroke | 5 | 5 | 5 | 5 | 3 | 3 | 3 | 3 |
| Ball path variations | 5 | 5 | 5 | 5 | 4 | 4 | 3 | 3 |

The individual items of Table 1 are described.

The definitions of S1, S2, L1, L2, H1, H2 and W2 are as described in the foregoing.

The "inertial moment" means the aforementioned inertial moment with respect to the right-left directions.

The "impact transmitted to hands" means the results of sensory evaluation made by 10 testers aged 30 to 52 having handicap of 5 to 15. Each of the testers used each of the clubs to putt 10 balls and made the following four-grade evaluation on the vibration transmitted to the hands (◎: very little vibration, ○: little vibration, Δ: perceivable vibration, ×: significant vibration). An evaluation value of a tested club is represented by a grade at which the largest number of testers rated the club.

The "ease of stroke" means the results of a sensory evaluation made by the above 10 testers, who each used each of the clubs to putt 5 balls. Each tester evaluated for the ease of stroke from backswing to just before impact with ball on a scale of 1-5 (the highest grade is at 5 whereas the lowest grade is at 1, the easier the stroke, the higher the point). An evaluation value of a tested club is represented by a rounded average value of the scores given by the ten testers.

The "ball path variation" means the results of a sensory evaluation made by the above 10 testers, who each used each of the clubs to putt 10 balls toward a target five yards away from the tester. The ball path variations relative to the target with respect to the right-left direction and the front-rear direction were standardized and evaluated on a scale of 1-5 (the highest grade is at 5 whereas the lowest grade is at 1, the smaller the variations, the higher the point). An evaluation value of a tested club is represented by a rounded average value of the scores given by the 10 testers.

In the three evaluation items, the examples achieved the better results than the comparative examples.

What is claimed is:

1. A golf putter head comprising:

a head body having a face surface, said head body including a body front portion including the face surface and extending in a toe-heel direction and a body rear portion extending in a face-back direction from a toe-heel center of a back side face of the body front portion, the body front portion and the body rear portion being formed in one piece; and a head rear portion affixed to a back-side end of the body rear portion and having a greater specific gravity than that of the head body, wherein provided that S1 represents a cross-sectional area of the head body with respect to a cross-section taken at a boundary portion between the body rear portion and the head rear portion and along a plane parallel to the face surface, whereas S2 represents a cross-sectional area of the head rear portion with respect to a cross-section taken at the boundary portion and along a plane parallel to the face surface, a value of (S2/S1) is 1.1 or more and 2.0 or less.

2. The golf putter head of claim 1, wherein provided that L1 represents a toe-heel length of the head body as determined at the boundary portion, whereas L2 represents a toe-heel length of the head rear portion as determined at the boundary portion, a value of(L2/L1) is 1.1 or more and 2.0 or less.

3. The golf putter head of claim 1, wherein provided that H1 represents a top-sole length of the head body as determined at the boundary portion, whereas H2 represents a top-sole length of the head rear portion as determined at the boundary portion, a value of (H2/H1) is 1.1 or more and 2.0 or less.

4. A golf putter comprising the golf putter head of claim 1.

5. The golf putter head of claim 1, wherein an entirety of the head rear portion is rearward of the back-side end of the body rear portion.

* * * * *